US006513427B2

(12) United States Patent
Pautrat

(10) Patent No.: US 6,513,427 B2
(45) Date of Patent: Feb. 4, 2003

(54) DEVICE FOR GUIDING MATERIAL WEBS IN ROTARY PRESSES

(75) Inventor: Jean-Claude Pautrat, Paris (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 220 days.

(21) Appl. No.: 09/728,268

(22) Filed: Dec. 1, 2000

(65) Prior Publication Data

US 2001/0029856 A1 Oct. 18, 2001

(30) Foreign Application Priority Data

Dec. 8, 1999 (DE) ..... 199 59 152
Jun. 28, 2000 (FR) ..... 00 08296 9

(51) Int. Cl.[7] ..... B41F 13/54

(52) U.S. Cl. ..... 101/228; 270/1.01; 270/5.01; 270/5.02; 270/20.1; 270/21.1; 226/4; 226/8; 226/109; 226/190; 493/320; 493/324; 493/357; 493/369

(58) Field of Search ..... 101/227, 228, 101/177, 181, 483, 226; 270/1.01, 5.01, 5.02, 20.01, 21.1, 50, 40, 52.07; 226/4, 8, 46, 108, 109, 110, 112, 115, 188, 190, 196.1; 493/320, 324, 356, 357, 369

(56) References Cited

U.S. PATENT DOCUMENTS 4,279,410 A * 7/1981 Bulza-Schünemann ..... 270/50
4,861,326 A * 8/1989 Kühner et al. ..... 493/357
5,086,964 A * 2/1992 Blaser ..... 226/4
5,117,753 A * 6/1992 Mamberer ..... 101/228
5,397,044 A * 3/1995 Suzuki ..... 101/228
5,400,940 A * 3/1995 Sato et al. ..... 101/228
5,421,567 A * 6/1995 Bolza-Schünemann .... 270/5.01
5,429,698 A * 7/1995 Hartmann et al. ..... 493/320
5,520,317 A * 5/1996 Eckert et al. ..... 226/196.1
5,542,350 A * 8/1996 Theilacker et al. ..... 101/228
5,676,056 A * 10/1997 Stein et al. ..... 101/226
5,775,222 A * 7/1998 Zweitfel et al. ..... 101/227
5,809,892 A * 9/1998 Krüger ..... 101/483
5,906,307 A * 5/1999 Albert et al. ..... 226/109
5,947,023 A * 9/1999 Bohrer et al. ..... 101/181
6,298,781 B1 * 10/2001 Dufour ..... 270/21.1
6,385,946 B1 * 5/2002 Singh ..... 493/357
6,408,748 B1 * 6/2002 Hajek et al. ..... 101/177

* cited by examiner

*Primary Examiner*—Eugene H. Eickholt
(74) *Attorney, Agent, or Firm*—Davidson, Davidson & Kappel, LLC

(57) ABSTRACT

A device for guiding material webs (A through D; E through H) via an angle-bar deck (2), including a folding section that is arranged on a plurality of planes (3.1, 3.2, 3.3), from where the material webs (A through D), (E through H) enter folding apparatuses (4), (5). Accommodated on longitudinal folding devices (8), (9) are infeed elements (7), which have guide sections (13), (14) that are-able to be operated independently of one another.

17 Claims, 3 Drawing Sheets

4
5
H1
H2
E1
E1
F1
F2
3.1
8
9
H1,H2
13
14
7
A1
A2
G1
G2
3.2
15
8
9
H1,H2
B1
B2
C1
C2
D1
D2
3.3
G1,G2
8
9
B1,B2
A1,A2
C1,C2,D1,D2
H1,H2
E1,E2,F1,F2
18
19
16
17

DEVICE FOR GUIDING MATERIAL WEBS IN ROTARY PRESSES

BACKGROUND INFORMATION

1. Field of the Invention

The present invention relates to a device for guiding material webs in rotary presses, in particular rotary presses used for producing print runs having different print volumes.

2. Background of the Invention

German Patent Application No. 195 39 693 A1 describes a device for pulling off superposed webs in a rotary press. In this related art configuration, a draw-off roller is provided between a print unit and a folding device; the draw-off roller is driven with a circumferential speed and set into a rotation that is adjusted to be higher than that of an impression cylinder. Provision is made for a plurality of pressure rollers, which are able to be forced to engage or disengage with the margins at both ends of a plurality of printed webs, which are laid one over another and around the outer peripheral area of the draw-off roller. The pressure rollers are rotatable and are provided at both ends along the outer peripheral surface of the draw-off roller. A pressing device is also provided for pressing the pressure rollers onto the margins at both ends of the printed webs, which are laid around the outer peripheral area of the draw-off roller. The multiplicity of the printed webs supplied by the print unit are laid one over another and guided around the outer peripheral surface of the draw-off roller, are each pressed at their margins, at both ends, by a plurality of pressing webs, against the outer peripheral surface of the draw-off roller, and pulled off by the driving and rotation of the draw-off roller, to ultimately arrive in the folding device.

German Patent Application No. 41 28 797 A1 refers to a paper web guide assembly in rotary presses. In the case of a paper web guide assembly for rotary presses having six plate-width printing cylinders, the object is to achieve substantial flexibility in the variation of paper web ribbons or segments with little outlay for equipment. Six folder formers are arranged on three planes for the paper web ribbons. This enables greater variability to be achieved in the mixing and uniting of individual ribbons, thereby substantially enhancing production flexibility, for example in a newspaper rotary press.

Japanese Patent Document No. 5-27402-U is directed to a folding device for rotary presses. Folding apparatuses, which are arranged downstream from rotary presses, include a plurality of folding sections. Two inner folding devices are provided, two folder formers being arranged in pairs; two formers are provided on a top plane, two others on a bottom plane; two outer folding units are mounted at both sides of the angle-bar superstructure at the level of the two inner folding units, a small clearance remaining therebetween. Also provided is a pull roller, which cooperates with a slitting knife, which longitudinally slits a material web being fed to the inner folding units. There are two angle-bar decks, so that the web path of one of the two longitudinally slit web halves can be exchanged for the other.

German Patent No. 32 37 504 C2 discusses a paper web for rotary presses. A paper web guiding mechanism is provided in a rotary press having a number of paper web guide rollers between printing units and formers of a folding apparatus. At least two formers are disposed side-by-side on a common horizontal plane, and at least one slitting device is provided for dividing a paper web into a remaining web and one partial web per paper web. Also provided on the same plane directly adjacent to the other folder formers, is an additional folder former that extends beyond the maximum paper web width. The paper web guide rollers upstream from a former infeed roller are designed to be at least one fourth longer than a maximum width of one of the printable paper webs in the printing units. For each paper web, two angle bars are provided, one of which is displaceably mounted transversely to the paper web's direction of travel.

Newspaper production often requires printing several editions on rotary presses. The editions are prepared in larger or smaller print runs, depending on whether they are intended for larger or smaller distribution regions. For that reason, several different rotary presses are needed to be able to print the editions one after another.

When one single edition is produced on merely one rotary press and, in fact, in successive intervals, this leads to a longer production time for the total edition. Inevitably, the decision to print one edition on two rotary presses is made in view of the large capital investments required for the second printing machine.

SUMMARY OF THE INVENTION

On the basis of the related art approaches outlined here, an object of the present invention is to produce print runs of different lengths independently of one another on a double-width rotary press.

The present invention provides a device for guiding material webs (A, B, C, D; E, F, G, H), via an angle-bar deck (2) of a folding section that is subdivided into a plurality of planes (3.1, 3.2, 3.3), from where the material webs (A through D), (E through H) enter folding apparatuses (4), (5). The present invention is characterized in that accommodated on longitudinal folding devices (8), (9) are infeed elements (7), which have guide sections (13), (14), which are able to be operated independently of one another.

There are many diverse advantages associated with the device according to the present invention. Subdividing the rotating guide element into guide sections that can be operated independently of one another allows a rotary press to be continuously operated to produce a large print run; on the other hand, a smaller print run can be produced independently of the large print run. This smaller print run can be guided over one of the independent guide sections, without have any adverse effect on the printing of the large print run. Thus, a double-wide newspaper rotary press makes it possible to independently and simultaneously produce different-volume print runs. Printing of the long print run can continue after the short print run is already finished printing, so that an additional print job can be prepared on the remaining, now available guide section. When working with newspaper and commercial web presses, the editions usually include completely identical sections, and are distinguished from one another only by inserts or local sections. These inserts or local sections can be printed individually in smaller, i.e. short print run, editions, independently of a longer print job, and simultaneously on one and the same rotary press.

In one advantageous refinement of the inventive idea, the guide element is fashioned, for example, as a former infeed roller and arranged above a folder former of one or a plurality of folder formers. A separate drive can be assigned to each of the two guide sections, it being possible for the drives to be driven independently of one another.

The former infeed-roller surfaces forming a traversing, rotating surface are rotatable with respect to one another and can be joined to one another, for example by way of a free-wheeling mechanism which permits both guide roller sections to rotate in common, as well as, in each case, separately with respect to one another. A mounting support for the former infeed roller that takes up as little construction space as possible is achieved by using one of the guide roller sections as a mounting support for the other guide roller section.

For that, a projection of a guide roller section—for example, a bearing—can engage with form locking in a recess at the other guide section. Besides a free-wheeling mechanism, a coupling, a neck-recess bearing arrangement, other devices, such as ball bearings, lubricated sleeve bearings, and the like would be quite suited for enabling independent rotation between the guide sections.

The folding sections in the superstructure each contain a plurality of longitudinal folding units. A plurality of longitudinal folding units can be mounted side-by-side in the folding apparatus superstructure. The longitudinal folding units are able to be positioned side-by-side, in pairs, for example, on three planes, thereby facilitating great variability in production when working with newspaper rotary presses.

Rotating web guide rollers in the superstructure, downstream from the dryer, in the cooling roller section, as well as upstream from the printing units in the imprinting unit area, can likewise be equipped quite advantageously with roller sections capable of being operated independently of one another. The web guidance can be so conceived that, during printing, parts of the web traverse all printing units, while other parts are guided, above or below individual print units, by-passing the same. This kind of flexibility is necessary if one is to always effectively utilize newspaper printing presses to capacity, as they represent substantial investments. The device proposed by the present invention further enhances the effective utilization of a printing press to capacity.

The web guide roller, which can be used, for example, as a former infeed roller, can be operated in superstructures both with and without slitting devices, the provision of slitting devices further enhancing the flexibility and versatility of a rotary press. The divided web guide roller is preferably used in newspaper rotary presses, however its application in commercial web presses is conceivable.

BRIEF DESCRIPTION OF THE DRAWINGS

The present invention is elucidated in the following on the basis of the drawing, in which.

DETAILED DESCRIPTION OF A PREFERRED EMBODIMENT

Figure 1:
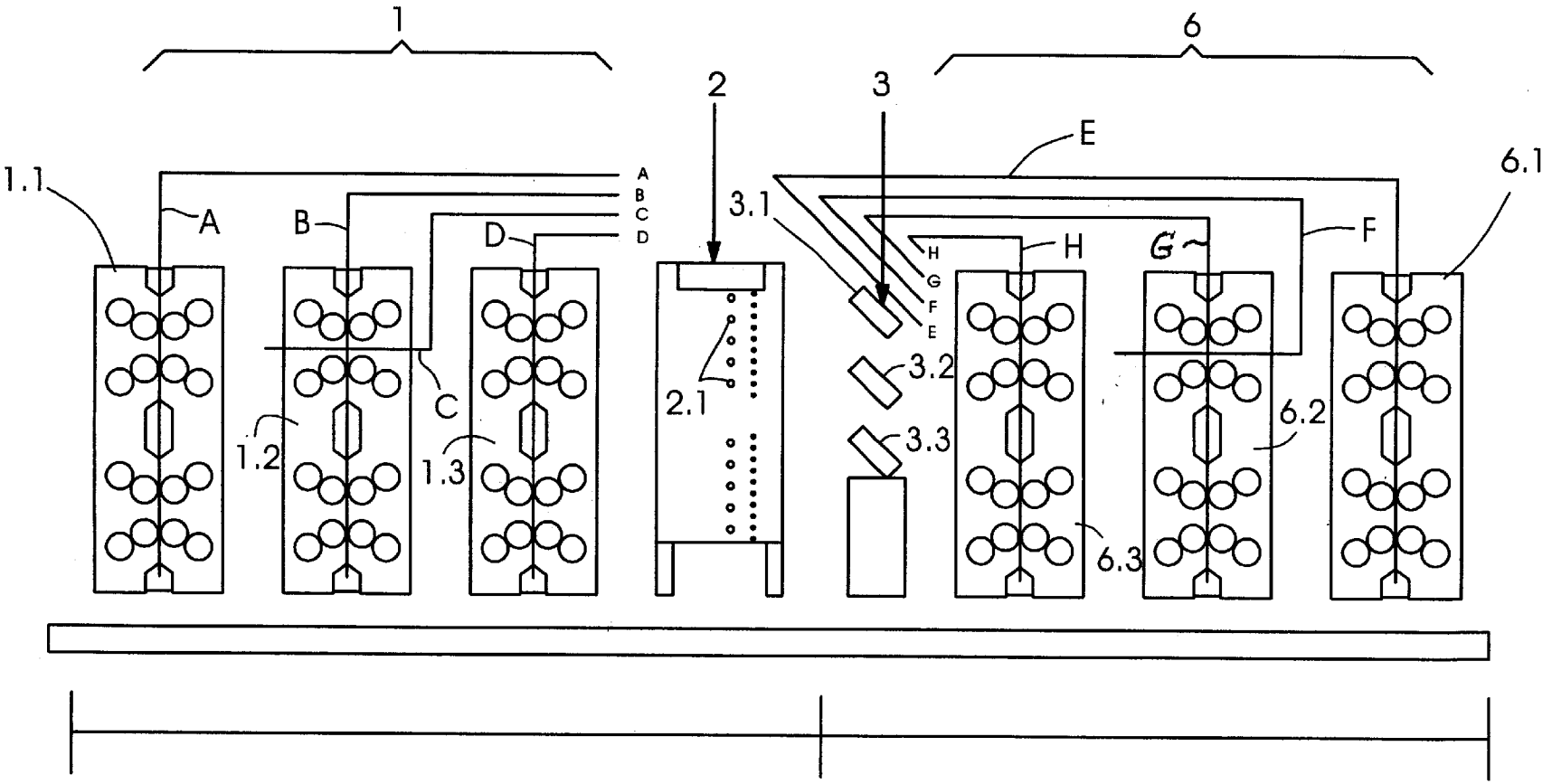
FIG. 1 shows a schematic view of a rotary press having two printing groups, each having three four-high units, including a common superstructure and common folding section.
Figure 3:
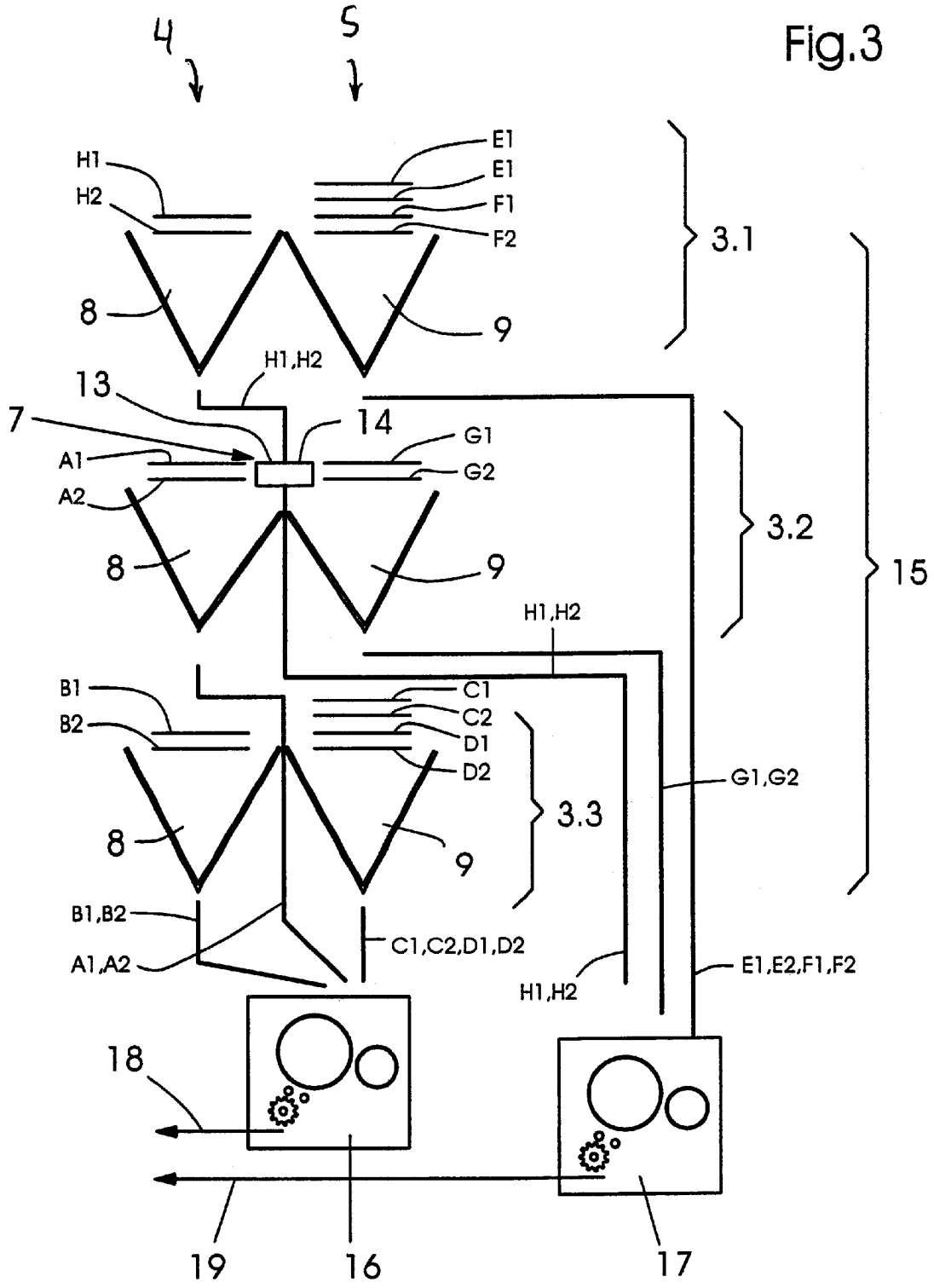
FIG. 3 shows an illustration of the longitudinal folding device provided in the superstructure.

FIG. 1 depicts a schematic view of a rotary press having two printing groups, each having three four-high units, including a common superstructure and common folding section. In this configuration, two printing groups 1, 6 are each provided with three four-high units, from which printed, multilayer web ribbons are fed via structure 2 to an angle bar common to both printing groups 1, 6. In angle-bar deck 2, which accommodates a plurality of variably positioned, stationary or displaceable angle bars 2.1, the differently printed material webs in printing groups 1 and 6, respectively, are brought together in accordance with the desired product array—i.e., in accordance with the various newspaper inserts—placed one over the other and, subsequently, further processed in cylinder sections of folding apparatuses 16, 17 (FIG. 3).

In first printing group 1, made up of four-high units 1.1, 1.2, and 1.3, material webs A, B, C and D are each printed using a different print unit configuration. Web A of print group 1 is printed 4/1 in first four-high unit 1.1, i.e., a top side of web A is printed in the superjacent print units, in succession in cyan, magenta, yellow and black, while the corresponding bottom side is printed black in four-high unit 1.1, in its top-most print unit, before web A leaves four-high unit 1.1. After exiting four-high unit 1.1, 4/1 printed web A enters the angle bars via structure 2.

In second four-high unit 1.2 of printing group 1, webs B and C are each printed with a different color pattern on the top and bottom side. Web B enters laterally into second four-high unit 1.2 and is printed black on both sides in the two top-most print units of four-high unit 1.2, before again exiting four-high unit 1.2 in the direction of angle-bar deck 2. Web C is printed 4/1 in four-high unit 1.2. It enters four-high unit 1.2, above the first print unit pair, and is guided around the transfer cylinder of the bottom print unit, cyan and yellow being printed there one after another on its top side. Web C subsequently traverses the other print units, where it is printed magenta and black. In the third print unit in four-high unit 1.2, web C is printed black on its top and bottom side. Web C, which at this point is likewise 4/1 printed, then exits four-high unit 1.2 below the top-most print unit of four-high unit 1.2, in which material web B has already been printed on both sides, 1 over 1.

In four-high unit 1.3 remaining in printing group 1, web D is printed when passing through all print units 4/4, web D running strictly vertically. Web D exits four-high unit 1.3, at the top end, in order to enter angle-bar superstructure 2.

For the sake of completeness, it is mentioned here that the four-high unit gets its name from the fact that two mutually opposing print units are mounted in each of these four print units. Below the structure only schematically shown in FIG. 2 and the web paths of the four-high units, the reel or roll changers that take up the web supply rollers are accommodated in the basement floors underneath the foundation. Through these reel changers (not shown in greater detail here), the four-high units of the two printing groups 1 and 6 are supplied with the web stock to be printed.

Analogously to printing group 1, the other printing group 6 includes three four-high units 6.1, 6.2 and 6.3, in which webs E, F, G and H are printed. In the illustrated exemplary embodiment, web E is printed 4/4 in four-high unit 6. 1, webs F and G are printed 4/2 and 1/1, respectively, in four-high unit 6.2 analogously to second four-high unit 1.2 of first printing unit 1. Web H is printed 4/4 in four-high unit 6.3. Since the web guidance and color application characteristics in the other printing group 6 are analogous to those just discussed for printing group 1, reference is made to the explanations already made in connection with printing group 1, to avoid being repetitive.

Webs A, B, C, D and E, F, G and H running out of printing groups 1, 6 enter into angle bar section 2; folded and united accordingly, from there, they are introduced into folding section 3, which is made up of a plurality of folding units, configured one over another in three planes 3.1, 3.2 and 3.3.

From there, webs A, B, C and D and E, F, G and H, respectively, enter into the cylinder sections of the folding apparatuses.

Figure 2:
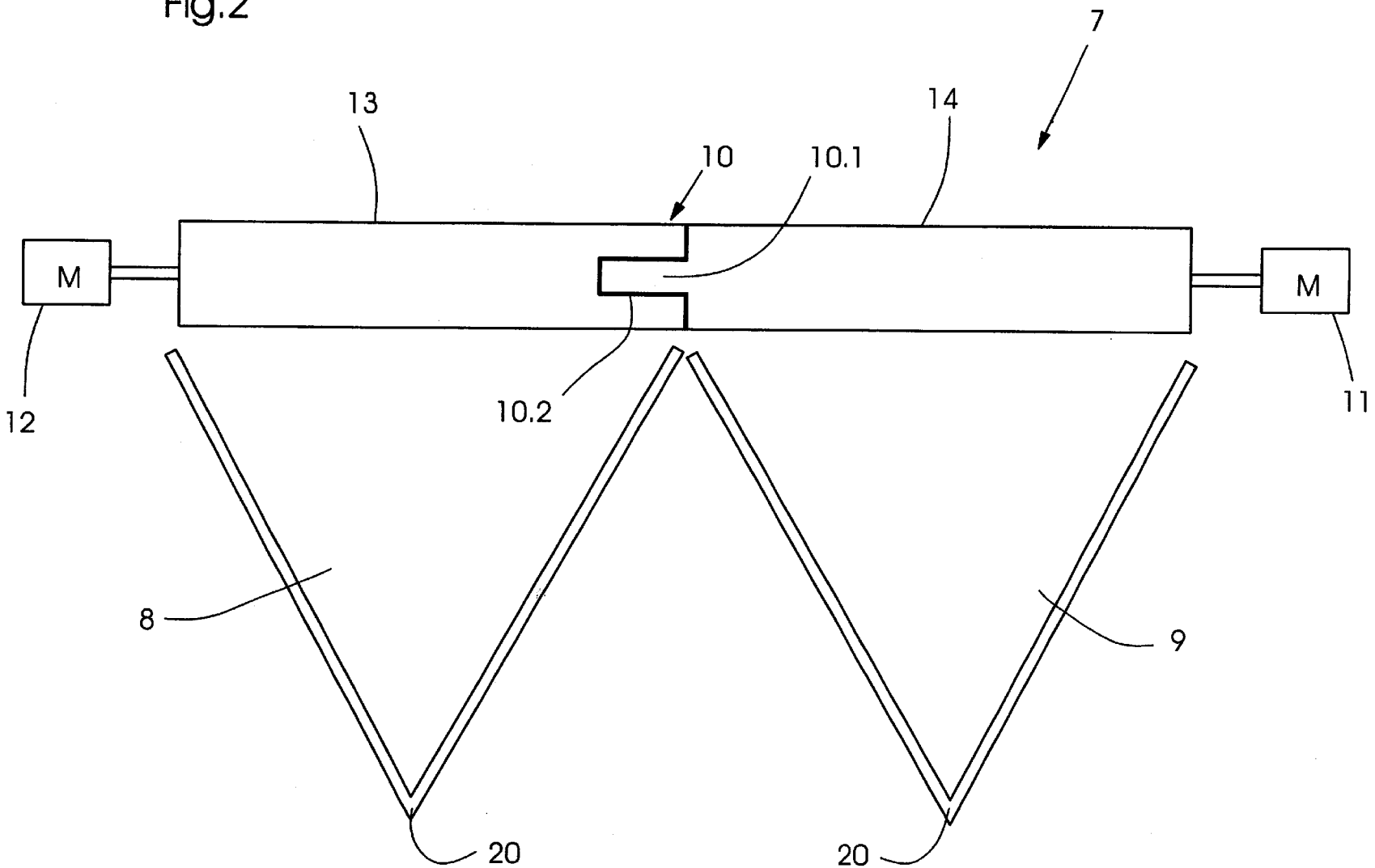
FIG. 2 shows the web guide roller provided in accordance with the present invention having web guide sections capable of being operated independently from one another.

FIG. 2 depicts in greater detail the web infeed roller according to the present invention having web guide sections that are able to be operated independently of one another.

Disposed side-by-side in pairs, in folding section 3 shown in FIG. 1, in three superjacent planes 3.1, 3.2 and 3.3, respectively, are folder formers 8, 9, over whose former noses 20, the web sections, having been longitudinally folded there, run off. In the illustration according to FIG. 2, web guide roller 7 functions as a divided former infeed roller 7, having two roller sections 13 and 14 which are capable of being operated independently of one another. The two roller sections 13 and 14 are each provided with one drive 11 and 12, respectively. The two roller sections 13 and 14 are joined to one another in such a way that one roller section 13 and 14, respectively, acts as a bearing support for the other roller section. For this, accommodated between roller sections 13 and 14 can be a coupling 10, which includes a neck 10.1, and hollow or recess 10.2, respectively, which render possible a form-locking connection of the two roller sections 13 and 14, respectively, without preventing their mutually independent rotation. Besides a coupling 10, ball bearings, lubricated sleeves, or other bearing forms can be implemented, which render possible an independent rotation of the two web guide sections 13 and 14 relatively to one another. This includes the possibility that one of web guide sections 13 and 14, respectively, can also be shut down while the other one is in the process of rotating. When working with double-wide newspaper rotary presses, it is beneficial that former infeed rollers 7 extend, for example, over the entire infeed width of both folder formers 8 and 9, respectively. In this context, one of guide sections 13, 14 is assigned to one folder former 8 and 9, respectively, so that, by way of former 8, a single- or multi-layer web ribbon is able to be processed independently of the web ribbon being fed over web guide section 14 into folder former 9.

When a plurality of web ribbons is involved, it is understood that webs A, B, C and D can be longitudinally slit by slitting devices already provided in angle-bar superstructure 2 or in full section 3 into partial webs A1, A2; B1, B2, C1, C2, D1 and D3 (See FIG. 3). This applies analogously to webs E, F, G and H, which can be divided by slitting devices into partial webs E1, E2, F1, F2, G1, G2, H1 and H2. The individual partial webs, in turn, can again be made of a plurality of web layers.

FIG. 3 illustrates the folding section in the superstructure in an enlarged representation.

Two longitudinal folder formers 8, 9 are adjacently disposed in each of three planes 3.1, 3.2 and 3.3. A former infeed roller 7 in accordance with the present invention is located above folder formers 8 and 9, respectively, which are disposed in plane 3.2.

Partial webs H1, H2 from printing group 6 run over folder former 8 in first plane 3.1, while partial webs E1, E2, F1 and F2 are longitudinally folded over adjacent former 9. Partial webs E1, E2, F1, F2 run past planes 3.2 and 3.3, respectively, into cylinder section 17 of a folding apparatus. Longitudinally folded partial webs H1, H2 run off a divided web guide roller 7, and are led past bottom-most plane 3.3, to likewise be fed into folding apparatus cylinder section 17.

Disposed on second plane 3.2 above longitudinal folder former 8, 9 is former infeed roller 7, subdivided into two web guide sections 13 and 14, respectively, in accordance with the representation in FIG. 2, each of which can be assigned to independent drive 11 and 12, respectively.

Partial webs A1, A2 run over web guide section 13; partial webs G1, G2 over web guide section 14, and subsequent to longitudinal folding at former 9, into folding-apparatus cylindrical section 17. On the other hand, upstream from bottom-most folding plane 3.3, partial webs A1, A2 run into folding-apparatus cylinder section 16.

In bottom-most folding plane 3.3, whose configuration is analogous to that of folding plane 3.1, partial webs B1, B2 are longitudinally folded by longitudinal former 8; and partial webs C1, C2, as well as D1 and D2 by former 9. These run, together with partial webs A1, A2, which are longitudinally folded in plane 3.2, into folding-apparatus cylindrical section 16. The arrangement according to the present invention of divided former infeed roller 7 enables either partial webs A1, A2 or partial webs G1, G2, to be guided independently of one another, in second plane 3.2 of folding section 3. Depending on the size of the print run, guidance of partial webs into different partial web ribbons is able to be achieved using divided former infeed roller 7, so that partial webs E1, E2, F1, F2, G1, G2, as well as H1 and H2 constitute a small print run, including a separate folder feeding device, and one can terminate the printing of this print run without adversely affecting the larger print run, made up of partial webs A1, A2, B1, B2, C1, C2, as well as D1 and D2. Work on this larger print run can be performed by way of separate delivery 18 assigned to folding apparatus 16 independently of delivery 19 in folding-apparatus cylinder section 17.

Cylinder sections 16, 17 can be for example include cutting cylinders for forming printed products, such as rotary blade folders.

The example elucidated here of a web guidance through folding section 3 is merely one of many possible examples of web guidance. Partial web ribbons A1, A2, B1, B2, C1, C2, as well as D1 and D2 could just as easily be print runs of a smaller print job, and partial web ribbons E1, E2, F1, F2, G1, G2, as well as H2 and H2, print runs of a larger print job. Also, former infeed roller 7 could be mounted on a different plane than plane 3.2 shown in FIG. 3, for example on all three planes 3.1, 3.2, 3.3 of folding section 3.

The present invention quite substantially improves production flexibility on web-fed rotary presses—particularly on newspaper rotary presses. Web guide rollers divided in accordance with the present invention can not only be used as former infeed rollers 7 in a folding section 3, but can likewise be installed as web infeed rollers, dancer rollers, web tension rollers, and as pull rollers for the material web, which are integrated in the particular web paths in the rotary press. For the sake of completeness, it is mentioned that the formats produced in folding section 3 in accordance with the present application are preferably tabloid formats or simple cross fold formats, which are perfectly customary formats used in folding operations in newspaper rotary presses. Tabloid formats or cross fold formats produced in such a manner in folding-apparatus cylinder sections 16, 17 downstream from folding section 3 can be followed, already in folding section 3 above the cylinder sections, by cross fold operations, double parallel folding operations, as well as by delta fold operations, so that copies delivered in delivery locations 18 and 19, respectively, can be produced in all common newspaper formats.

Reference Symbol List

2. first printing group
1.1 four-high unit 4/1
1.2 four-high unit 4/1, 1/1
1.3 four-high unit 4/4
2. angle-bar deck
2.1 angle bars
3. folding section
3.1 first plane or level
3.2 second plane or level
3.3 third plane or level
4. first folding section
5. second folding section
6. second printing group
6.1 four-high unit 4/4
6.2 four-high unit 4/1, 1/1
6.3 four-high unit 4/1
A web of first group
A1 web ribbon
A2 partial web ribbon
B web of first group
B1 partial web ribbon
B2 partial web ribbon
C web of first group
C1 partial web ribbon
C2 partial web ribbon
D web of first group
D1 partial web ribbon
D2 partial web ribbon
E web of second group
E1 partial web ribbon
E2 partial web ribbon
F web of second group
F1 partial web ribbon
F2 partial web ribbon
G web of second group
G1 partial web ribbon
G2 partial web ribbon
H second group
H1 partial web ribbon
H2 partial web ribbon
7. divided web roller
8. first folding unit
9. second folding unit
10. coupling
10.1 neck
10.2 recess
11. drive
12. drive
13. first guide roller section
14. second guide roller section
15. folder former level
16. cylinder section
17. cylinder section
18. first delivery of copy
19. second delivery of copy
20. folder former nose

What is claimed is:

1. A device for guiding webs of material, via an angle-bar deck for a folding section that is subdivided into a plurality of planes, from which the webs enter folding apparatuses, the device comprising:

longitudinal folding devices; and at least one infeed element accommodated at the longitudinal folding devices, the infeed element having a first and a second guide section, the first guide section being operable independently of the second guide section.

2. The device for guiding material webs as recited in claim 1 further comprising separate drives assigned to the first and second guide sections.

3. The device for guiding material webs as recited in claim 1 further wherein the first and second guide sections are provided with a free-wheel mechanism.

4. The device for guiding material webs as recited in claim 3 wherein the free-wheel mechanism is arranged between the first and second guide sections.

5. The device for guiding material webs as recited in claim 1 wherein the longitudinal folding devices are part of the folding section.

6. The device for guiding material webs as recited in claim 5 wherein the longitudinal folding devices are accommodated in a side-by-side configuration.

7. The device for guiding material webs as recited in claim 5 wherein the longitudinal folding devices are accommodated in three planes.

8. The device for guiding material webs as recited in claim 1 wherein the first and second guide sections are rotatable with respect to one another.

9. The device for guiding material webs as recited in claim 1 wherein the first guide sections is used as a mounting support for the second guide section.

10. The device for guiding material webs as recited in claim 9 wherein one of the first and second guide sections is supported with form locking in the other of the first and second guide sections.

11. The device for guiding material webs as recited in claim 10 wherein the one guide section is provided with a neck accommodated in a recess of the other guide section.

12. The device as recited in claim 1 wherein the infeed elements are former infeed rollers.

13. The device as recited in claim 1 wherein the infeed element is a web infeed roller or a dancer roller.

14. A folding-apparatus having a superstructure for guiding webs of material comprising:

longitudinal slitting devices for dividing the material webs into at least two partial webs;

folding sections disposed in a plurality of planes;

longitudinal folding devices; and at least one infeed element accommodated at the longitudinal folding devices, the infeed element having a first and a second guide section, the first guide section being operable independently of the second guide section.

15. A web-processing rotary press comprising:

a device for guiding material webs via an angle-bar deck having a plurality of longitudinal roller devices disposed on a plurality of planes; and longitudinal folding devices; and at least one infeed element accommodated at the longitudinal folding devices, the infeed element having a first and a second guide section, the first guide section being operable independently of the second guide section.

16. A folding-apparatus superstructure for guiding webs of material via an angle-bar deck comprising:

folding sections disposed in a plurality of planes, from which the webs enter folding apparatuses;

longitudinal folding devices; and at least one infeed element accommodated at the longitudinal folding devices, the infeed element having a first and a second guide section, the first guide section capable of being driven independently of the second guide section.

17. A folding-apparatus superstructure for guiding webs of material via an angle-bar deck comprising:

longitudinal slitting devices for dividing the webs into at least two partial webs;

folding sections disposed in a plurality of planes, the webs entering folding apparatuses at the planes;

longitudinal folding devices; and at least one infeed element accommodated at the longitudinal folding devices, the infeed element having a first and a second guide section, the first guide section capable of being supported independently of the second guide section.

* * * * *